United States Patent [19]

Hopings et al.

[11] 4,246,866

[45] Jan. 27, 1981

[54] APPARATUS FOR APPLYING A PATTERN ON A SUBSTRATE

[75] Inventors: Donald B. Hopings, Toledo; Richard C. Phillips, Maumee, both of Ohio

[73] Assignee: Libbey-Owens-Ford Company, Toledo, Ohio

[21] Appl. No.: 62,158

[22] Filed: Jul. 30, 1979

[51] Int. Cl.[3] ..... B41F 15/08

[52] U.S. Cl. ..... 118/213; 101/126; 101/421

[58] Field of Search ..... 101/123, 126, 129, 124, 101/114, 115, 421; 118/213, 406

[56] References Cited

U.S. PATENT DOCUMENTS

| | | | |
|---|---|---|---|
| 1,840,073 | 1/1932 | Williams | 101/123 |
| 2,696,167 | 12/1954 | Babbitt et al. | 101/126 |
| 3,719,141 | 3/1973 | Jatta et al. | 101/126 |
| 4,040,352 | 8/1977 | Curti | 101/126 X |

*Primary Examiner*—Evan K. Lawrence

*Attorney, Agent, or Firm*—Collins, Oberlin & Darr

[57] ABSTRACT

A unitary, one-piece support element adapted to completely surround a glass substrate in a screen stenciling apparatus. The support element is in the form of a collar having an opening complementary to the shape of the substrate and offers support for the stencil screen during a stenciling operation to maintain the same in a flat condition throughout. Also embodied in the apparatus is a glass aligning arrangement to accurately locate the glass substrate in preparation for the stenciling operation.

10 Claims, 13 Drawing Figures

APPARATUS FOR APPLYING A PATTERN ON A SUBSTRATE

BACKGROUND OF THE INVENTION

The present invention relates generally to the art of stenciling designs or patterns on an underlying substrate, such as a glass sheet for example, and, more particularly, to a glass aligning arrangement and a support for the stencil screen used in such a printing operation.

The well-known "silk screen" coating or printing process is especially suited for applying patterns on glass sheets which are ultimately used as glazing closures in vehicles such as automobiles and the like. Typically, this process involves lowering a stencil screen onto an underlying glass sheet and then forcing the coating or printing material, as by a squeegee for example, through the perforated area constituting the pattern in the screen onto the surface of the glass sheet to form the desired pattern thereon. The screen is then lifted off the sheet to allow replacement of the printed sheet with a fresh sheet.

While such conventional "silk screen" printing apparatus have satisfactorily performed their function when applying patterns or designs interiorly of the marginal edges of the glass sheet, problems are encountered when printing to the very edge of the glass, such as is required on certain glass sheets embodied in recent automobile designs. The reason for this is that the perforated area defining the pattern in the screen must project slightly past the marginal edge of the sheet to assure the application of the printing material right up to such edge. The squeegee force acting on the perforated pattern of the screen to expel the coated material therethrough tends to stretch and flex this pattern portion over the marginal edge of the glass sheet. The repeated flexing or stretching of such pattern portion in a mass production operation results in premature wear and possible tear therealong, requiring frequent and costly screen replacement in addition to the loss of production in order to effect such screen replacement.

SUMMARY OF THE INVENTION

Therefore, it is a primary object of the present invention to provide an improved apparatus for applying coating material to substrates and which includes a novel support for the stencil screen utilized in such apparatus.

It is another object of this invention to form the support of a unitary, one-piece construction vertically movable into encircling engagement about the glass sheet to be coated.

It is a further object of the present invention to provide a novel glass aligning arrangement to accurately position the glass sheet in alignment with the overlying screen and the above-mentioned support in an automated operation.

The foregoing and other objects, advantages and characterizing features of the present invention will become clearly apparent from the ensuing detailed description thereof, considered in conjunction with the accompanying drawings, wherein like reference numerals denote like parts throughout the various views.

DESCRIPTION OF THE PREFERRED EMBODIMENT

Figure 1:
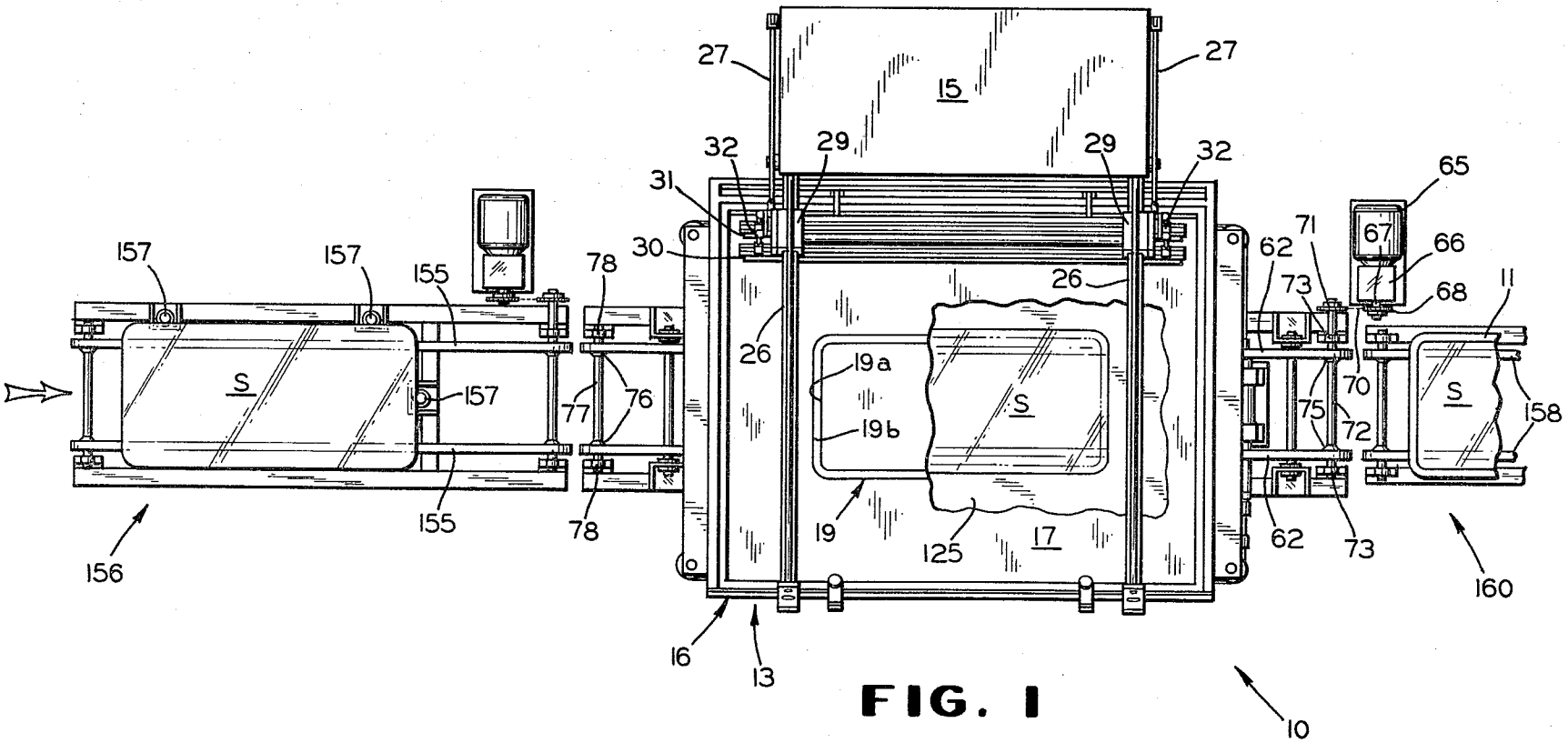
FIG. 1 is a top plan view of a screen stenciling apparatus, partly broken away for clarity, and embodying certain novel features of the present invention.

Referring now in detail to the illustrated embodiment depicted in the accompanying drawings, there is shown in FIG. 1 a printing apparatus of the "silk screen" stenciling type, designated in its entirety by numeral 10 and embodying the novel features of this invention, for applying a pattern on the upper surface of a substrate. In the illustrated embodiment depicted, the substrate is a glass sheet S (FIG. 2) of generally rectangular configuration in outline and the pattern is in the form of a continuous peripheral band 11 of predetermined width and printed on the upper surface of the sheet along the entire marginal edge thereof. The outer peripheral edge of the band 11 is coincident with and extends up to the very edge of the sheet S.

Figure 3:
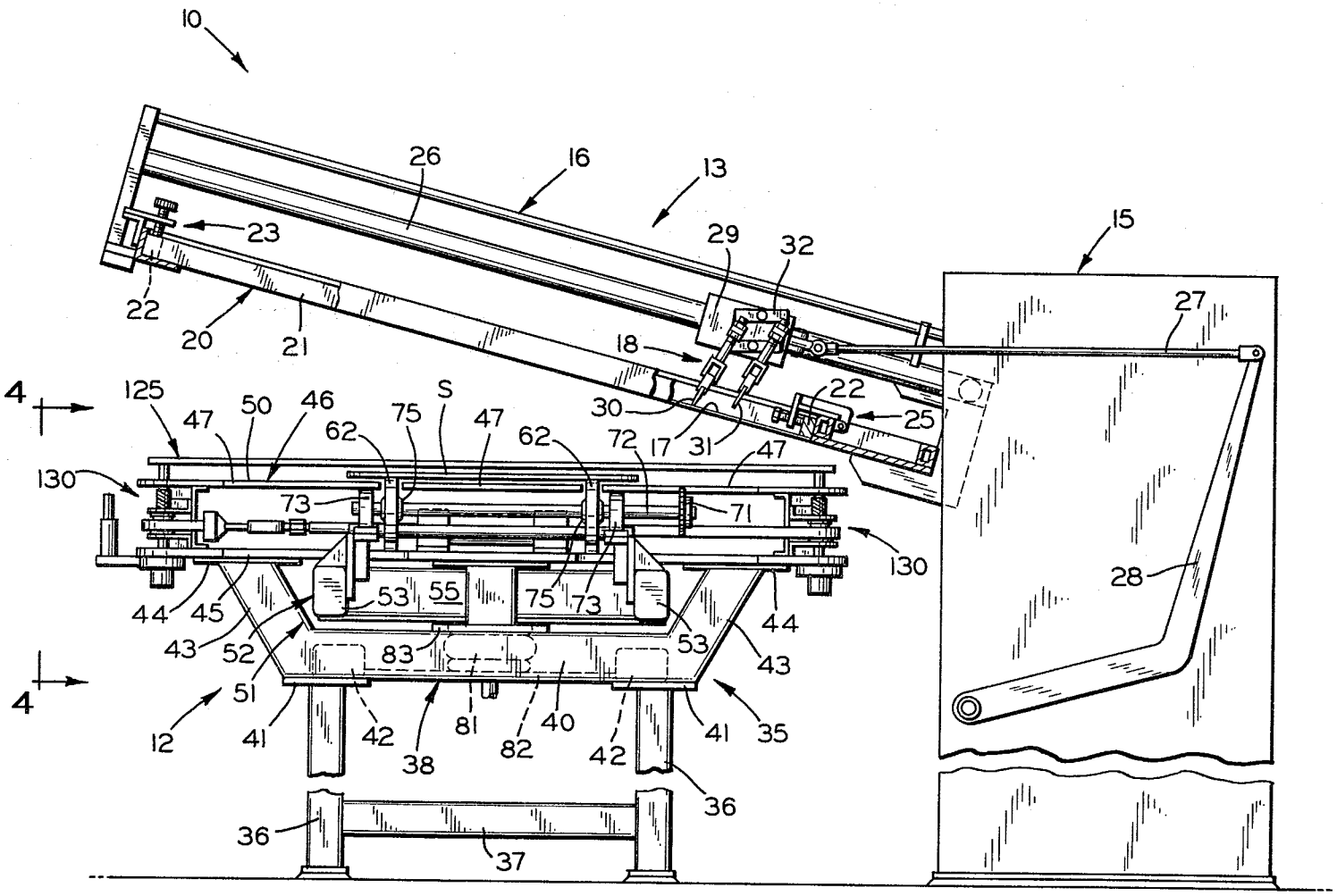
FIG. 3 is an end elevational view of the apparatus of FIG. 1.

As best shown in FIG. 3, the printing apparatus 10 includes a substrate supporting table, generally designated 12 and hereinafter more fully described, and an overlying coating or printing head, generally designated 13, mounted on a box-like base structure 15 for pivotal movement between a lower, operative position and an upper, inoperative, out-of-the-way position. This base structure 15 also can serve as the housing for the printing apparatus control system (not shown).

The printing head 13 comprises a suitable frame 16 for supporting the stencil screen 17 and the squeegee and flood bar assembly 18. The screen 17, hereinafter sometimes referred to as a "silk screen", is of conventional construction and, in the illustrated embodiment depicted in FIG. 1, is formed with a generally rectangularly shaped design or pattern 19 of predetermined, uniform width defined by an inner edge 19*a* and an outer peripheral edge 19*b*. While the major body portion of screen 17 is coated or otherwise formed to be impervious for preventing the flow of the printing material therethrough, the pattern 19 is pervious and constitutes a perforated area which permits the passage of the printing material therethrough. The screen 17 is adapted to overly the glass sheet in a manner substantially orienting the perforated pattern 19 in vertical registry with the marginal edge portion of the glass sheet; however, the outer peripheral edge 19*b* of pattern 19 is designed to extend slightly past the marginal edge of the glass sheet when the screen 17 is disposed on the upper surface of the glass sheet. The reason for this overlap relationship is to assure printing of the material onto the glass sheet right up to the very edge thereof.

As best shown in FIG. 3, silk screen 17 is supported on a frame member, generally designated 20, composed of longitudinal members 21 and end members 22. The frame member 20 is suitably mounted on the frame 16 by appropriate supports and properly held down as by hold-down assemblies 23 and 25. While the screen 17 is commonly referred to as a "silk screen", it should be understood that the screen is not necessarily made of silk but can be formed of any suitable material having the necessary resistance to chemical and mechanical deterioration, such as stainless steel, nylon and other suitable synthetic materials for example.

The squeegee and flood bar assembly 18 is mounted for reciprocal movement on elongated rails 26 and connected by rods 27 to suitable crank mechanisms 28 disposed along each side of the base structure 15 for reciprocating the squeegee and flood bar assembly 18 along the silk screen 17 when in its operative position. The assembly 18 includes an elongated squeegee bar 30 and an elongated flood bar 31 mounted in spaced, parallel relation on a pair of laterally spaced brackets 32 pivotally mounted on a pair of reciprocal slides 29 forming a part of the assembly 18. The squeegee bar 30 is adapted to engage and press against the screen 17, forcing the printing material through the perforated pattern 19 onto the underlying substrate, i.e. the glass sheet S, as the bar 30 moves longitudinally in one direction across the screen 17 by crank mechanisms 28. The flood bar 31, when in its operative, proximate position adjacent the screen 17, functions to distribute or disperse the printing material evenly over the underlying screen 17 during the return stroke of the assembly 18 in readiness for the next printing operation. Accordingly, the squeegee bar 30 and flood bar 31 are alternatively moved into their operative positions during the active and return strokes, respectively, of the assembly 18. Suitable means (not shown) are provided for pivoting bracket 32 to shift the squeegee bar 30 and flood bar 31 into their respective operative positions at the proper times. The printing head 13 has been only cursorily described since it is of conventional construction and, per se, forms no part of the present invention. Thus, details of the frame 16, the actuating means for pivoting the same, the actuator for pivoting brackets 32 to alternately lower and raise the squeegee bar 30 and flood bar 31, as well as the hold-down assemblies 23 and 25, have been omitted for the sake of simplicity.

The means for individually supporting the glass sheets to be printed includes the table 12 which is located beneath the printing head 13. The table 12 comprises a main frame 35 suitably supported on upstanding legs or columns 36 connected together by horizontal tie members 37. The main frame 35 includes a plurality of spaced, generally U-shaped cross members 38 each having a horizontal portion 40 (FIGS. 3 and 4) rigidly secured adjacent its opposite ends to mounting plates 41, in turn, welded or otherwise fixedly secured to the upper ends of legs 36. The cross members 38 are connected together by horizontally extending, hollow structural beams 42 rigidly secured at their respective ends to the horizontal portions 40 of cross members 38. As best shown in FIG. 3, each cross member 38 is formed at its opposite ends with inclined portions 43 extending upwardly in a divergent relation and which are provided with bearing plates 44 for rigidly mounting an elongated support plate 45 thereon.

Figure 7:
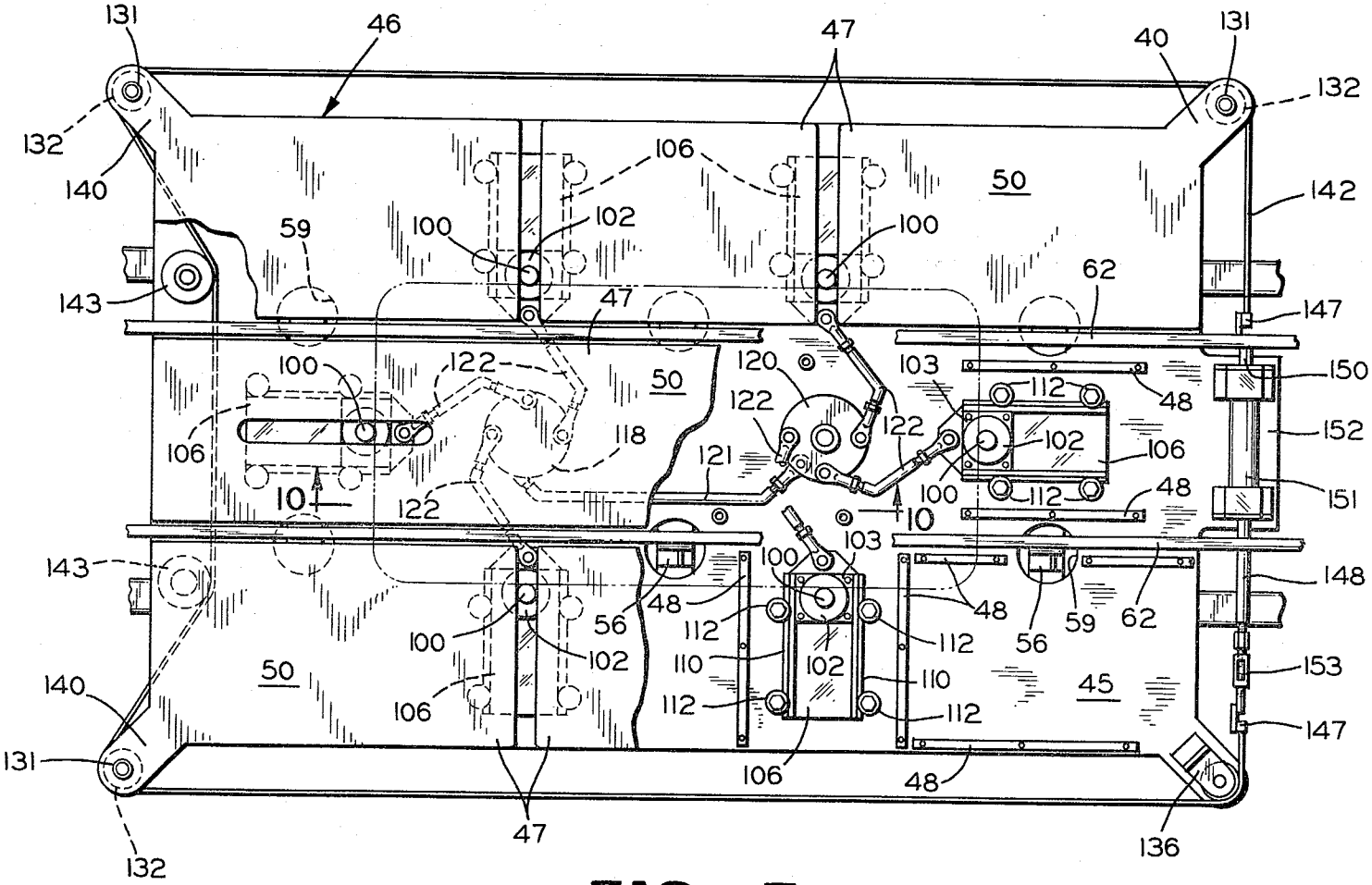
FIG. 7 is a top plan view of the glass supporting table, partly broken away for clarity, and showing details of the glass aligning arrangement forming a part of this invention.

A table top or deck 46, formed of a plurality of spaced segments 47, is suitably mounted on the support plate 45 as by means of a series of vertical supports or deck risers 48 (FIG. 7). The spaces between segments 47 forming deck 46 provide clearance or passageways for the glass aligning devices and conveyor belts, hereinafter identified and described and which are raised above the deck during operation of the apparatus. In any event, the several segments 47 constituting the deck 46 have upper surfaces lying in a common horizontal plane and conjointly define a supporting surface 50 for the glass sheets to be printed.

A vertically movable conveyor section, generally designated 51, is provided for advancing an incoming glass sheet into the desired position and depositing the same on the deck supporting surface 50. To this end, the section 51 includes a vertically reciprocal frame 52 comprising longitudinally extending hollow beam members 53 and transversely extending hollow beam members 55 suitably connected at their respective opposite ends to form a rigid box-like structure.

Mounted on each of the transverse beam members 55 adjacent the opposite ends thereof are a pair of conveyor belt supports 56 (FIG. 8) rigidly secured to the beam members 55, as by fasteners 57. Each support 56 has an upright web portion 58 projecting through an opening 59 in the support plate 45 and terminating in an inwardly directed flange 60. An elongated, generally T-shaped guide 61 is mounted on the longitudinally aligned flanges 60 for supporting the upper, active run of an endless conveyor belt 62. An idler roller 63 is suitably mounted and journalled for rotation on the web 58 of each conveyor belt support 56 for guiding the lower run of the associated belt 62.

Figure 4:
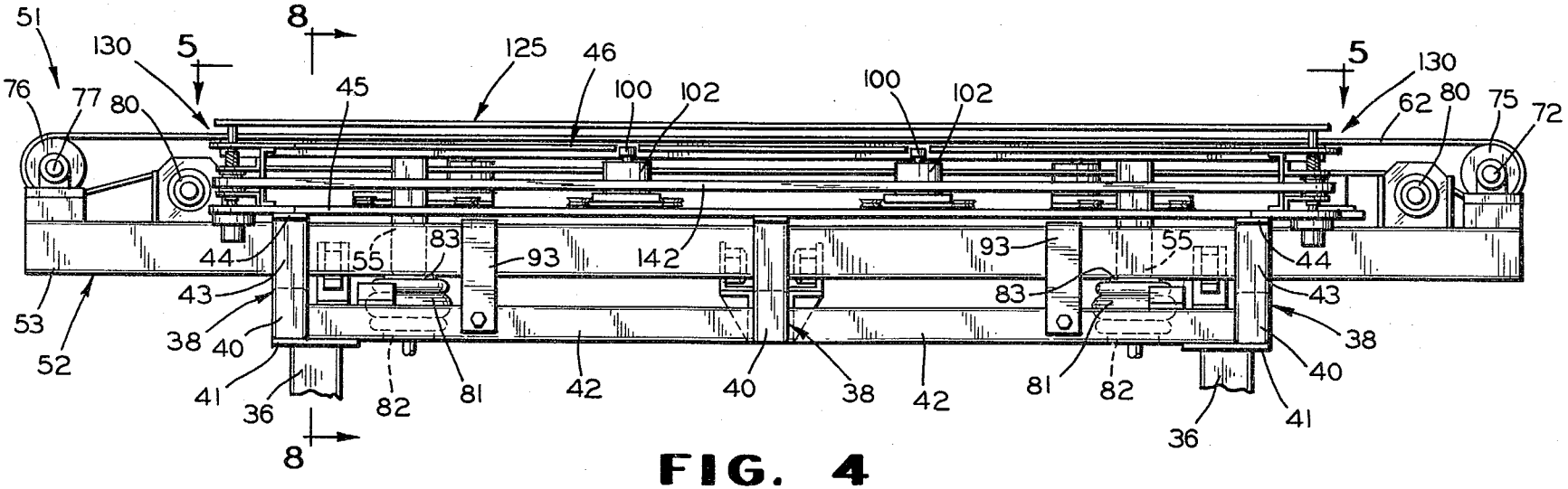
FIG. 4 is a fragmentary, front elevational view of the apparatus of FIG. 1, looking in the direction of arrows 4—4 of FIG. 3.

As best shown in FIGS. 1, 3 and 4, the means for driving the two conveyor belts 62 includes an electric motor 65 connected by the usual gear reduction box 66 to an output shaft 67 having a drive sprocket 68 mounted thereon. A drive chain 70 is entrained about the sprocket 68 and a sprocket 71 mounted on a drive shaft 72 at one end of the conveyor frame 52 and suitably journalled in spaced bearings 73. The two conveyor belts 62 are entrained about spaced, but coaxially aligned, drive pulleys 75 mounted on the drive shaft 72 and a pair of spaced, coaxially aligned idler pulleys 76 mounted on a shaft 77 at the other end of the conveyor frame 52 and suitably journalled for rotation in spaced bearings 78. Thus, the conveyor belts 62 are driven in orbital paths in unison on guides 61 about drive pulleys 75 and idler pulleys 76 in their active runs and in their inactive runs are guided about rollers 63 and tension pulleys 80 located adjacent the opposite ends of conveyor frame 52.

The means for raising and lowering the conveyor section 51 and thereby conveyor belts 62 comprises a pair of longitudinally spaced actuators 81 in the form of axially expansible bellows (FIGS. 4 and 8) suitably mounted at their lower ends on base plates 82 extending between beams 42 of the main frame 35 and affixed at their upper ends to plates 83 rigidly secured to the conveyor section frame 52. The actuators 81 are operative in unison to raise and lower the frame 52 and thereby conveyor belts 62 above and below the glass supporting surface 50 of deck 46.

Figure 8:
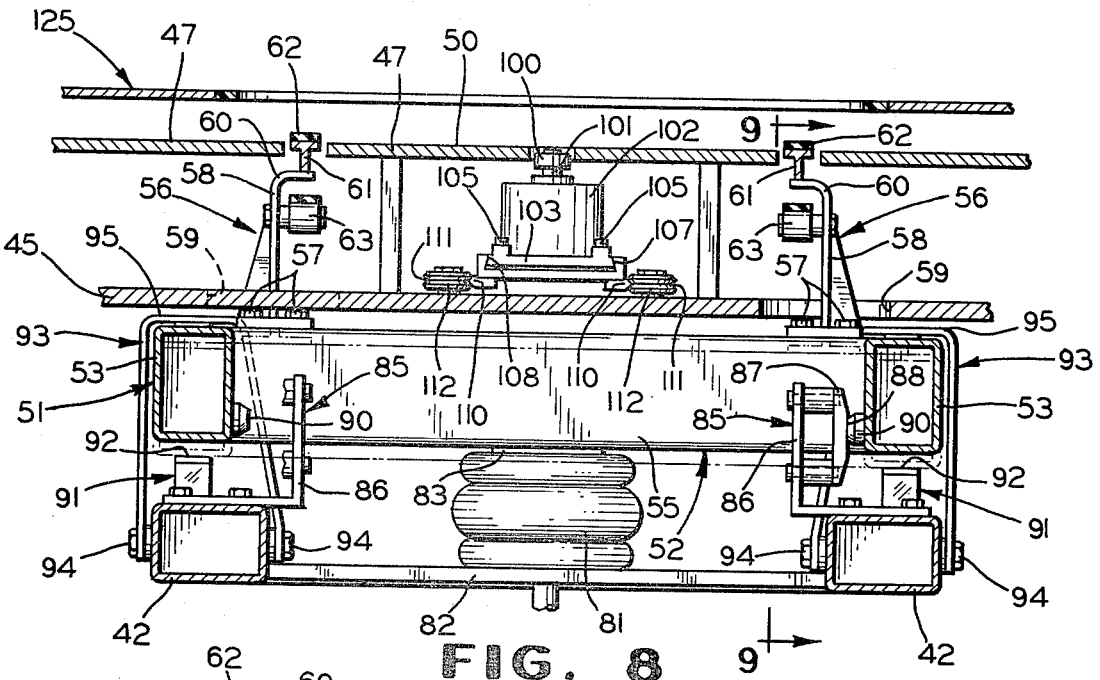
FIG. 8 is a vertical sectional view, on an enlarged scale, taken along line 8—8 of FIG. 4.
Figure 9:
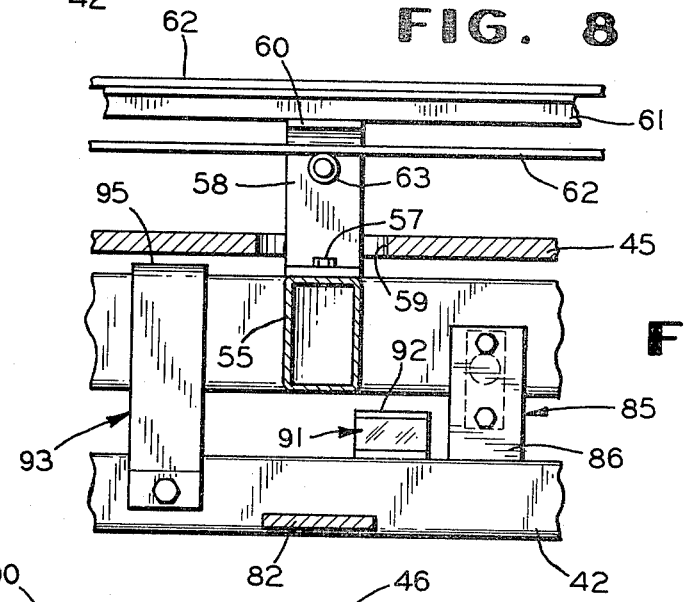
FIG. 9 is a vertical sectional view, taken along line 9—9 of FIG. 8.

The means for guiding the conveyor section frame 52 during its vertical reciprocating movement includes a plurality of guide assemblies 85 (two of which are shown in FIG. 8), each comprising an angle bracket 86 secured at one leg thereof to the hollow beam 42 of main frame 35 and having a guide element 87 secured to the other leg. The guide element 87 is formed with a bearing surface 88 against which a stud 90 affixed to conveyor frame beam 53 bears during vertical movement of the conveyor frame 52.

Means are provided for limiting upper and lower movement of the conveyor section frame 52, such means including a plurality of lower stops 91 rigidly secured to beams 42 and having abutment surfaces 92 limiting downward movement of the frame 52. The upper stops are in the form of inverted U-shaped brackets 93 rigidly secured adjacent the lower ends of their vertical legs to beams 42 as by suitable fasteners 94. The bight portions 95 of the brackets 93 extend over and about the upper ends of conveyor frame beams 53 and serve as abutment members limiting the upward movement of the frame 52.

Figure 10:
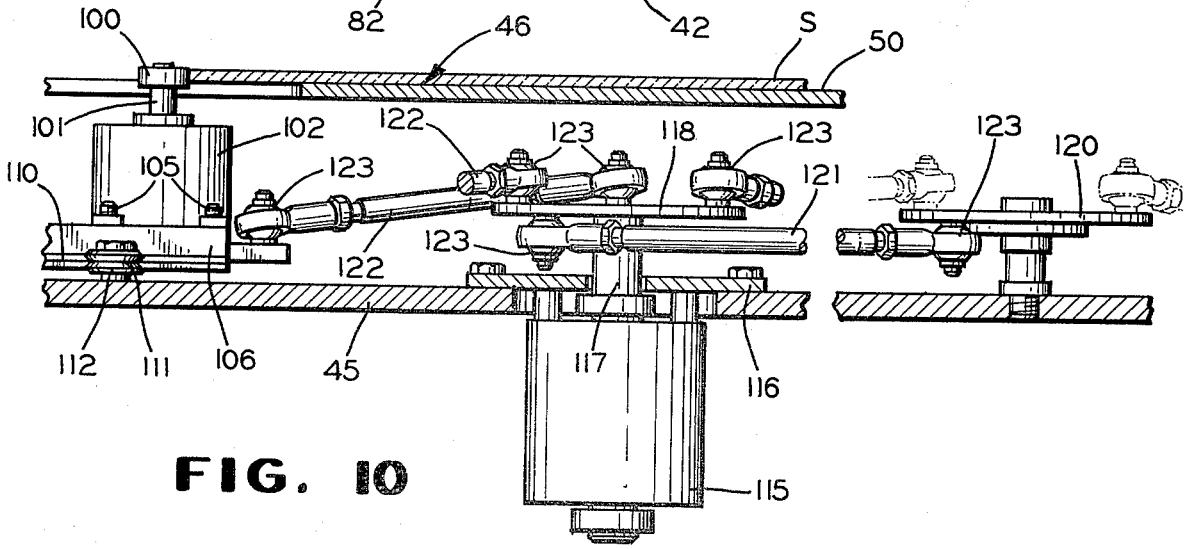
FIG. 10 is a fragmentary vertical sectional view, on an enlarged scale, taken along line 10—10 of FIG. 7.

A significant feature of this invention resides in the means for precisely aligning the glass sheet S on deck surface 50 relative to the overlying screen 17. As best shown in FIGS. 7, 8 and 10, such means includes a plurality of adjustable stops 100 mounted for vertical and horizontal movement on the table 12, as will presently appear. Each stop 100 is in the form of a disc mounted on the distal end of a piston rod 101 connected to the usual reciprocal piston of an actuating cylinder 102. The several cylinders 102 are operative to raise and lower the stops 100 between an upper position slightly above glass supporting surface 50 and a lower position therebeneath.

In order to reciprocate the stops 100 toward and away from the glass sheet, each cylinder 102 is provided with a base plate 103 adjustably mounted, as by screws 105, on a slide 106 and having opposite tapered edges 107 complementary to the dove-tailed formation 108 provided on the slide 106. Each slide 106 is formed with a V-shaped lateral edge 110 engageable with the complementary-shaped grooves 111 of opposed sets of guide rollers 112. The slides 106 are actuated by a drive arrangement including a rotary actuator 115 (FIG. 10) suitably secured to support plate 45, as by means of a mounting plate 116 suitably bolted on plate 45, and having an output shaft 117 surmounted by a drive disc 118. The drive disc 118 is connected to a slave disc 120 by a connecting rod 121, the slave disc 120 suitably journalled for rotation on support plate 45. The connecting rod 121 transmits the rotary movement of drive disc 118 to slave disc 120 so as to effect rotation of both in unison in the same direction. In the illustrated embodiment depicted, each disc 118, 120 is connected to three slides 106 by adjustable connecting rods 122, each connected at its opposite ends to its associated disc and slide by universal ball joints 123. Thus, rotation of the actuator 115 is operative to rotate the discs 118 and 120 in unison in the proper direction to effect movement of the slides 106 and thereby stops 100 inwardly and outwardly toward and away from the glass sheet S.

Figure 2:
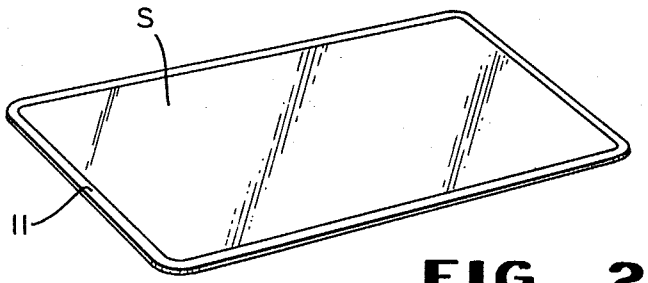
FIG. 2 is a perspective view of a glass sheet, showing a peripheral band imprinted on one surface thereof along the entire marginal edge thereof.

As earlier noted, a serious problem encountered in applying the coating or printing material to the very edge of a glass sheet, as is required to print the peripheral band 11 on sheet S of the illustrative embodiment depicted in FIG. 2, is that the squeegee force acting on the perforated pattern 19 of the screen, which pattern 19 extends slightly past the marginal edge of the glass sheet, tends to deform or flex the perforated pattern 19 over the marginal edge of the sheet. Such repeated action in a mass production stenciling operation causes the pattern portion to wear prematurely and sometimes rupture, requiring frequent screen replacement and adding materially to production costs.

The present invention provides a solution to this problem by incorporating a support in the form of a collar, generally designated 125, adapted to surround the entire marginal edge of the sheet to be printed and offers support for the screen 17, particularly the perforated pattern portion 19, to maintain the same in a flat or planar condition throughout and thereby avoid premature failure of the screen. The collar 125 is formed of a substantially rigid material, preferably a metal such as aluminum, in a unitary, one-piece construction. The collar 125 has a generally rectangular configuration in plan of substantially the same outside dimensions as table deck 46 and is formed with a central rectangular opening 126 complementary to the outline of the sheet to be printed. Of course, the specific size and shape of opening 126 can vary as dictated by the size and shape of the glass sheet being processed.

Figure 6:
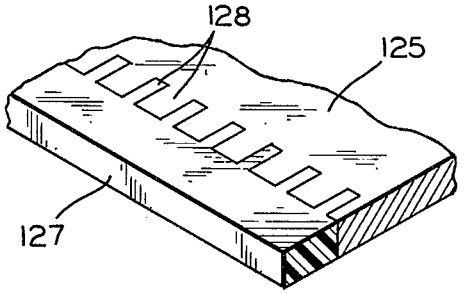
FIG. 6 is a perspective sectional view, on an enlarged scale, taken along the line 6—6 of FIG. 5.
Figure 5:
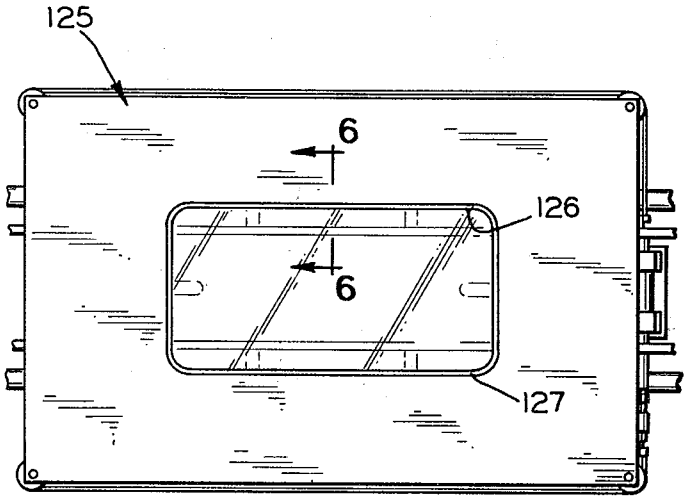
FIG. 5 is a top plan view, on a reduced scale, of the apparatus of FIG. 4, showing the stencil screen support constructed in accordance with this invention.

The opening 126 is formed by removing a section of slightly larger size than the sheet to be processed out of the interior of collar 125 and then lining the inner edge with a strip 127 suitable plastic material, preferably polyurethane for example, to provide a resiliently yieldable edge surface encompassing and engageable with the marginal edge of the glass sheet to avoid damage thereto. As shown in FIG. 6, the strip 127 can be joined to the inner edge of collar 125 by means of a rabbet joint 128, or any other suitable mechanical or adhesive means. The thickness of collar 125, which includes the strip 127, generally corresponds to the thickness of the glass sheet to be printed, the important factor being that the upper surface of collar 125 resides in the same horizontal plane as the upper surface of the sheet.

Figure 11:
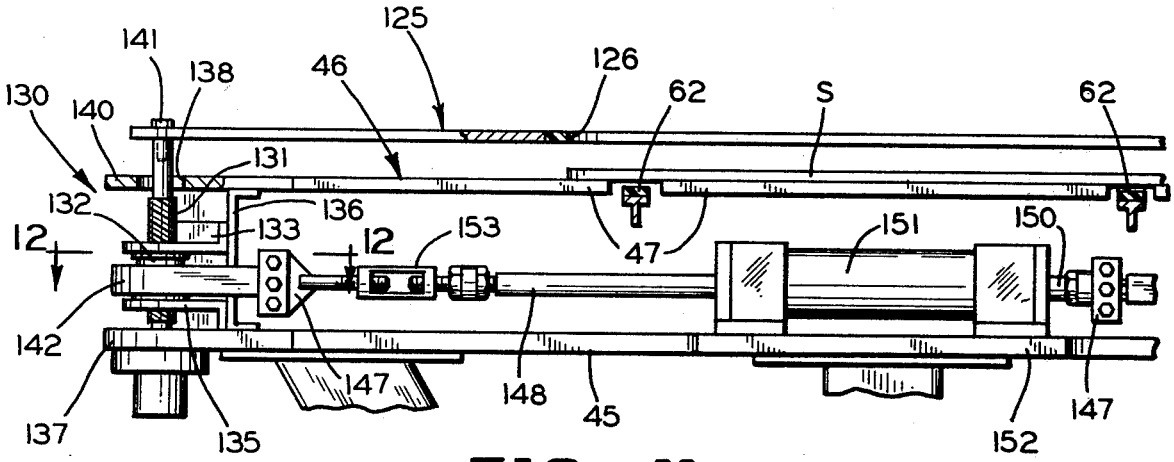
FIG. 11 is a fragmentary end elevational view, partly in section, showing details of the screen support reciprocating mechanism.

The collar 125 is mounted for vertical reciprocal movement between a lower position resting on the deck surface 50 and an upper position thereabove to permit the admission of a glass sheet therebetween upon the advancement of such sheet to the printing station. The means for raising and lowering the collar 125 comprises a plurality of jack screw assemblies 130 mounted on the table frame 35 and each operatively connected to one of the four corners of the collar 125. As best shown in FIG. 11, each jack screw assembly 130 comprises an elongated, upright screw 131 extending vertically upwardly through a rotatable nut 132, which is fixed against axial movement between a pair of angle brackets 133 and 135 welded or otherwise fixedly secured to a horizontally extending structural member 136 located between support plate 45 and deck 46 and forming a part of the table framework.

Each screw 131 projects downwardly through an extension 137 forming part of the support plate 45 and can be suitably journalled for rotation therein. The screw 131 projects upwardly from nut 132 through a suitable opening 138 formed in an extension 140 of the deck 46 and is connected at its upper end to one corner of the collar 125 by a suitable fastener 141. Of course, rotation of the nut effects vertical raising and lowering of its associated screw 131.

Figure 12:
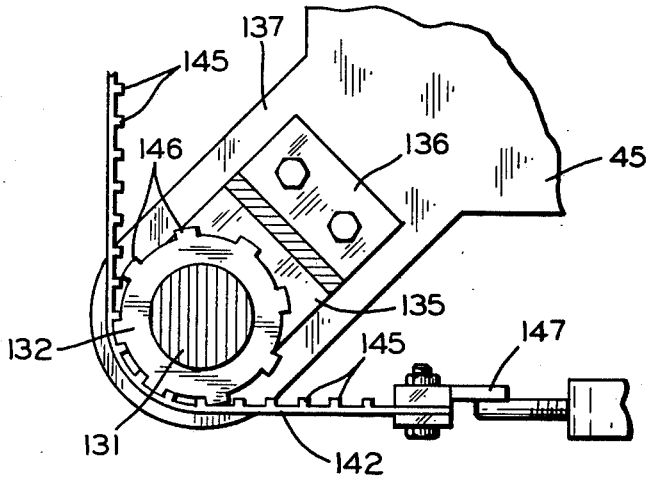
FIG. 12 is a horizontal sectional view, on an enlarged scale, taken along the line 12—12 of FIG. 11.

Referring now to FIGS. 11 and 12, the means for rotating the nuts 132 include a drive belt 142 of the timing belt type entrained about the four nuts and about a pair of spaced tension pulleys 143 (FIG. 7) suitably journalled for rotation on the table frame 52 and located at one end thereof. The timing belt 142 is formed along its inner side with equally spaced ribs 145 for intermeshing engagement with the splines 146 formed on the outer peripheral surfaces of the nuts 132. The opposite ends of the belt 142 are suitably connected, as by means of coupling members 147, to piston rods 148 and 150 projecting axially outwardly from the opposite ends of an actuating cylinder 151 suitably mounted on an axial extension 152 of support plate 45 and connected at their inner ends to a reciprocal piston (not shown) mounted within the cylinder 151. The length of belt 142 can be axially adjusted by means of a turnbuckle 153 connecting the threaded end portion of piston rod 148 to the threaded rod portion of coupling member 147. Thus, cylinder 151 is operative to actuate the drive belt 142 in either direction to turn the several nuts in unison and effect raising and lowering of the screws 131 and thereby collar 125.

The mode of operation of the above-described apparatus embodying the novel screen support and glass alignment arrangement of this invention in applying a peripheral band 11 on a glass substrate, which band extends to the very edge thereof, is as follows:

With the printing head 13, collar 125, and conveyor section 51 in their upper positions, a glass sheet S is placed on a pair of laterally spaced conveyor belts 155 at a loading station 156 and is accurately positioned thereon against suitable aligning stops 157. This produces a signal which, through a suitable control system (not shown), activates a timer controlling retraction of stops 157 after a timed delay, say three seconds for example, and controls activation of the drives for conveyor belts 155 and 62 which advance the glass sheet S from loading station 156 via belts 155 and onto conveyor belts 62 to move the sheet into the printing station. The timer controlling the drive for conveyor belts 62 is such that, when the sheet S is substantially centered above the deck 46, the belts 62 stop and actuators 81 become operative to lower the conveyor section 51 and thereby belts 62 below the deck surface 50 to deposit the sheet thereon. With the sheet resting on surface 50, the several cylinders 102 are actuated to raise their respective aligning stops 100 above surface 50. Discs 118 and 120 are then rotated in unison in the same direction (clockwise as viewed in FIG. 7) to move the stops 100 inwardly against the sheet, accurately positioning the same in vertical alignment with the opening 126 of collar 125 and the overlying screen 17.

Figure 13:
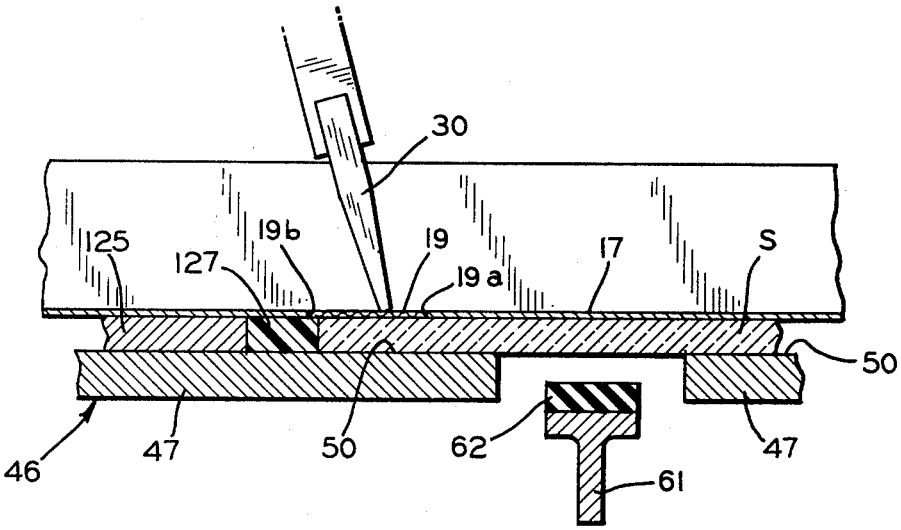
FIG. 13 is an enlarged, vertical sectional view, showing a squeegee bar and stencil screen in their respective operative positions.

With the sheet accurately positioned on deck surface 50, the several stops 100 are moved outwardly away from the sheet by rotation of the discs 118 and 120 in the opposite or counter-clockwise direction, as viewed in FIG. 7 and then retracted below surface 50 by cylinders 102. Cylinder 121 is next actuated to drive the timing belt 142 in the proper direction to, in turn, rotate the several screws 131 and lower collar 125 onto the deck surface 50 in encompassing relation about the sheet located thereon. The printing head 13 is then lowered to bring screen 17 into engagement with the glass sheet and the squeegee bar 30 is lowered into engagement with screen 17. With the screen 17 having been previously flooded with printing material, the squeegee bar 30 is moved longitudinally, as by means of the crank mechanisms 28, along the screen 17 (FIG. 13) to force the printing material through the pattern 19 formed in the screen and thereby apply the desired design or band 11 onto the upper surface of the sheet up to the very edge thereof. The collar 125 supports that portion of the pattern 19 extending slightly past the marginal edge of the glass sheet S as the squeegee bar 30 sweeps thereover to maintain it in a horizontal plane flush with the glass surface and thereby avoid any bending and stretching of such pattern 19 as would otherwise occur in the absence of collar 125.

At the completion of the printing stroke, the squeegee and flood bar assembly 18 and printing head 13 are sequentially raised, leaving the desired band 11 on sheet S. Once the screen 17 clears the glass sheet, the collar 125 is raised upwardly above the sheet S and conveyor section 51 is raised to elevate the belts 62 and lift the printed sheet off deck supporting surface 50. The belts 62 then advance the printed sheet out of the printing station and transfer the same onto another pair of conveyor belts 158 at a transfer station 160 for advancement to a further processing station. When the printed sheet clears the printing station, the conveyor belts 62 are stopped, conditioning the apparatus for the next succeeding sheet and the above-described cycle is repeated.

Actuation of the various cylinders, actuators, and conveyor drives is effected by conventional fluid control valves (not shown) or motors properly sequenced for operation by conventional timers and/or by conventional limit switches (also not shown) incorporated in the electrical control system. Each of the timers and/or switches triggers subsequent stages of operation of the various actuators and conveyor drives and since such arrangements are known and, per se, form no part of the present invention, no detailed description or further amplification is believed necessary.

From the foregoing, it is clear that the objects of this invention have been fully accomplished. A new and useful support element adapted to completely surround a glass substrate is incorporated in a screen stenciling apparatus to offer support for the perforated pattern portion of a screen during a stenciling operation. The support maintains the screen, and especially the pattern formed therein, in a horizontal plane flush with the glass surface to avoid bending and premature failure of the screen. Additionally, a novel glass aligning arrangement is provided to accurately and precisely position the glass substrate in vertical registry with the stencil screen and support element of this invention.

It is to be understood that the form of the invention herein shown and described is to be taken as an illustrative embodiment only of the same, and that various changes in the shape, size and arrangement of parts, as well as various procedural changes, may be resorted to without departing from the spirit of the invention.

We claim:

1. In apparatus for applying coating material in a desired configuration onto a flat substrate positioned on a supporting surface and including a stencil screen having a pattern formed therein disposed above said supporting surface and adapted to engage said substrate, and means for forcing coating material through said pattern of said screen in a desired configuration onto the upper surface of said substrate, the improvement comprising a collar above said supporting surface in spaced relation thereto and having an opening therein complementary to the outline of said substrate, means for moving said collar into embracing relation with said substrate for completely surrounding the marginal edge thereof, said collar having a surface for supporting at least a portion of said pattern during the coating operation.

2. Apparatus according to claim 1, including means for accurately locating said substrate on said supporting surface relative to said collar and said stencil screen while said collar is in said spaced relation.

3. Apparatus according to claim 1, wherein said collar supporting surface resides in a common horizontal plane with the upper surface of said substrate when in said embracing relation.

4. Apparatus according to claim 1, wherein said supporting surface is horizontal including means for accurately locating said substrate on said supporting surface relative to said collar and said stencil screen, said locating means comprising a plurality of moveable stops on a frame and disposed exteriorly of the substrate periphery, means on said frame for horizontally moving said stops inwardly and outwardly toward and away from said substrate, and means for vertically moving said stops above and below said supporting surface.

5. In apparatus for applying coating material in a desired configuration onto a flat substrate positioned on a supporting surface and including a stencil screen having a pattern formed therein disposed above said supporting surface and adapted to engage said substrate, and means for forcing coating material through said pattern of said screen in a desired configuration onto the upper surface of said substrate, the improvement comprising a collar above said supporting surface and having an opening therein complementary to the outline of said substrate, means for moving said collar into embracing relation with said substrate for completely surrounding the marginal edge thereof, said collar having a surface for supporting at least a portion of said pattern during the coating operation, said collar being formed of a unitary, one-piece construction having an elastomeric liner defining said opening to provide a resiliently yieldable surface engageable with the marginal edge of said substrate.

6. In apparatus for applying coating material in a desired configuration onto a flat substrate positioned on a supporting surface and including a stencil screen having a pattern formed therein disposed above said supporting surface and adapted to engage said substrate, and means for forcing coating material through said pattern of said screen in a desired configuration onto the upper surface of said substrate, the improvement comprising a collar above said supporting surface and having an opening therein complementary to the outline of said substrate, means for moving said collar into embracing relation with said substrate for completely surrounding the marginal edge thereof, said collar having a surface supporting at least a portion of said pattern during the coating operation, a frame for said supporting surface, said moving means comprising a plurality of jack screw assemblies mounted on said frame and operatively connected to said collar for lowering and raising said collar toward and away from said supporting surface.

7. Apparatus according to claim 6, wherein each of said jack screw assemblies comprises a jack screw and a rotatable nut associated therewith, and an endless orbital belt entrained about the several nuts for rotating the same in unison to actuate said jack screws, respectively.

8. In apparatus for applying coating material in a desired configuration onto a flat substrate positioned on a horizontal supporting surface and including a stencil screen having a pattern formed therein disposed above said supporting surface and adapted to engage said substrate, and means for forcing coating material through said pattern of said screen in a desired configuration onto the upper surface of said substrate, the improvement comprising a collar above said supporting surface in spaced relation thereto and having an opening therein complementary to the outline of said substrate, means for moving said collar into embracing relation with said substrate for completely surrounding the marginal edge thereof, said collar having a surface for supporting at least a portion of said pattern during the coating operation, means for accurately locating said substrate on said supporting surface relative to said collar and said stencil screen, said locating means comprising a plurality of moveable stops on a frame disposed exteriorly of the substrate periphery, and means for vertically moving said stops above and below said supporting surface.

9. Apparatus according to claim 8, including means on said frame for horizontally moving said stops inwardly into engagement with the substrate periphery and outwardly away therefrom.

10. Apparatus according to claim 9, including slides mounted on said frame for horizontal sliding movement relative thereto, means mounting said stops on said slides, respectively, a pair of drive discs mounted on said frame, means for rotating said discs in unison to move said slides and thereby said stops horizontally toward and away from said substrate, and means connecting certain of said slides to each of said discs for movement thereby.

* * * * *